US010796673B2

(12) United States Patent
Son

(10) Patent No.: US 10,796,673 B2
(45) Date of Patent: Oct. 6, 2020

(54) MOUTHPIECE PATCH FOR MUSICAL INSTRUMENT

(71) Applicant: Leto R&D Corporation, Closter, NJ (US)

(72) Inventor: Hye Seong Son, Closter, NJ (US)

(73) Assignee: Leto R&D Corporation, Closter, NJ (US)

( * ) Notice: Subject to any disclaimer, the term of this patent is extended or adjusted under 35 U.S.C. 154(b) by 0 days.

(21) Appl. No.: 16/150,433

(22) Filed: Oct. 3, 2018

(65) Prior Publication Data

US 2019/0103076 A1 Apr. 4, 2019

Related U.S. Application Data

(60) Provisional application No. 62/568,059, filed on Oct. 4, 2017.

(51) Int. Cl.
*G10D 9/02* (2020.01)

(52) U.S. Cl.
CPC ..... *G10D 9/02* (2013.01)

(58) Field of Classification Search
CPC ..... G10D 9/02
See application file for complete search history.

(56) References Cited

U.S. PATENT DOCUMENTS 9,779,704 B1 * 10/2017 Chang ..... G09B 15/00

* cited by examiner

*Primary Examiner* — Kimberly R Lockett
(74) *Attorney, Agent, or Firm* — Kim IP Law Group PLLC

(57) ABSTRACT

A mouthpiece patch for a mouthpiece of a wind instrument including a body having a posterior end, an anterior end, lateral side walls, an upper surface and a lower surface. The patch further includes a recessed region provided in the upper surface and extending in a widthwise direction and configured to receive the teeth of a user.

20 Claims, 3 Drawing Sheets

MOUTHPIECE PATCH FOR MUSICAL INSTRUMENT

CROSS-REFERENCE TO RELATED APPLICATION

This application claims priority under 35 U.S.C. § 119(e) to U.S. Provisional Application Ser. No. 62/568,059, filed Oct. 4, 2017, and entitled "Mouthpiece Patch for a Musical Instrument," the disclosure of which is hereby incorporated by reference in its entirety for all purposes.

BACKGROUND OF THE INVENTION

A musical wind instrument typically includes a mouthpiece and a resonator. The mouthpiece is configured to provide an opening through which air from a user's mouth enters the resonator to produce varying tones. The mouthpiece is partly placed inside the user's mouth in order to play the instrument such that the user's teeth are in contact with the mouthpiece. Consequently, the mouthpiece is susceptible to damages from bite-marks and scratches resulting from contacting the user's teeth. Additionally, the user's teeth may be damaged by the mouthpiece due to biting down on the mouthpiece. Further, vibrations generated while playing the musical wind instrument are conducted from the instrument to the user's teeth, which can cause discomfort to the user.

In contrast, the subject disclosure relates to a mouthpiece patch for a musical instrument that enables a user to rest his/her teeth in the patch to ensure proper placement of a user's teeth, to enhance the user's comfort while playing the instrument and to protect the mouthpiece from scraping by a user's teeth.

BRIEF SUMMARY OF THE DISCLOSURE

According to an exemplary embodiment, the subject disclosure provides a mouthpiece patch for a mouthpiece of a wind instrument comprising a substantially planar body comprising a polymer. The body includes a posterior end, an anterior end, lateral side walls, an upper surface, a lower surface, and a recessed region extending in a widthwise direction and configured to receive the teeth of a user. According to an aspect, the polymer is silicone and the body is flexible.

According to an aspect, the recessed region is substantially linear. According to a further aspect, the recessed region is curved to substantially match a profile of the user's teeth. The recessed region extends from one lateral side wall to the other lateral sidewall, and the recessed region is disposed adjacent the anterior end of the body.

According to an aspect, the mouthpiece patch can have a substantially rectangular, substantially oval, substantially circular, or substantially square profile in plan view. According to an aspect, the anterior end is curved, the posterior end is curved, and the lateral side walls are substantially linear. According to an aspect, all edges of the body are rounded to enhance sealing of air from the user's mouth to the mouthpiece.

According to an aspect, the mouthpiece patch further comprises indicia for indicating use of the patch and placement of the user's teeth into the recessed region of the body. The indicia is positioned adjacent the posterior end of the body and can be formed from non-toxic ink.

According to an aspect, the mouthpiece patch further preferably includes a fastener on the lower surface for securing the mouthpiece patch to a musical instrument mouthpiece.

According to an exemplary embodiment, the subject disclosure provides a mouthpiece for a wind instrument comprising a mouthpiece patch a substantially planar body comprising a polymer. The body includes a posterior end, an anterior end, lateral side walls, an upper surface, a lower surface, and a recessed region extending in a widthwise direction and configured to receive the teeth of a user The mouthpiece comprises a recessed portion configured to matingly receive the mouthpiece patch.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

In the drawings.

DETAILED DESCRIPTION OF THE DISCLOSURE

Figure 1:
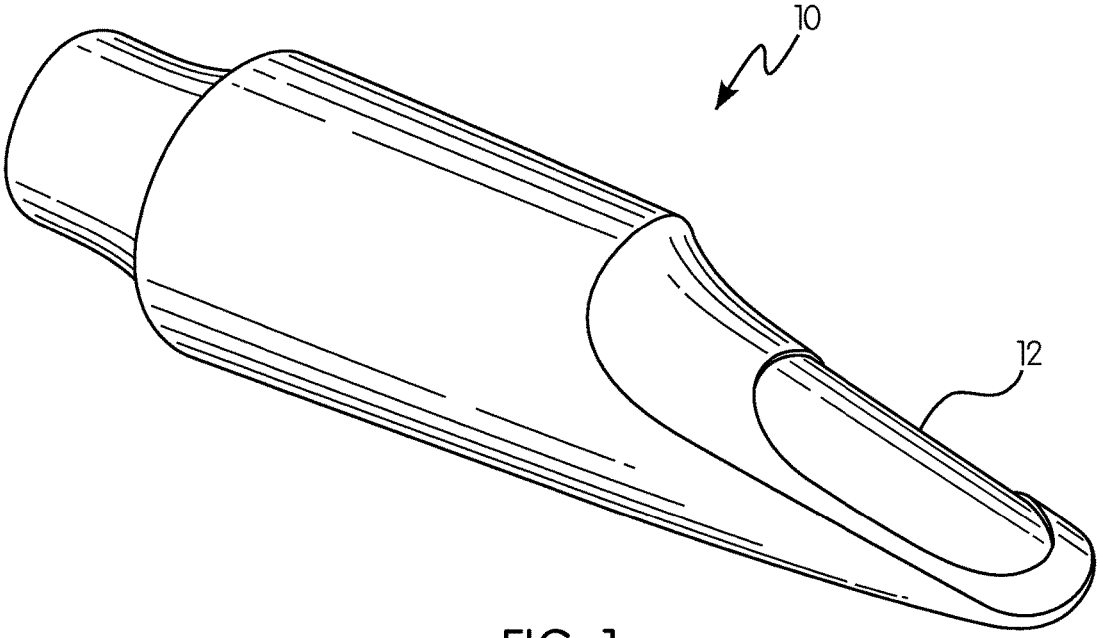
FIG. 1 is a perspective view of a mouthpiece for a wind instrument in with the mouthpiece patch accordance with the subject disclosure omitted for clarity of illustration.
Figure 2:
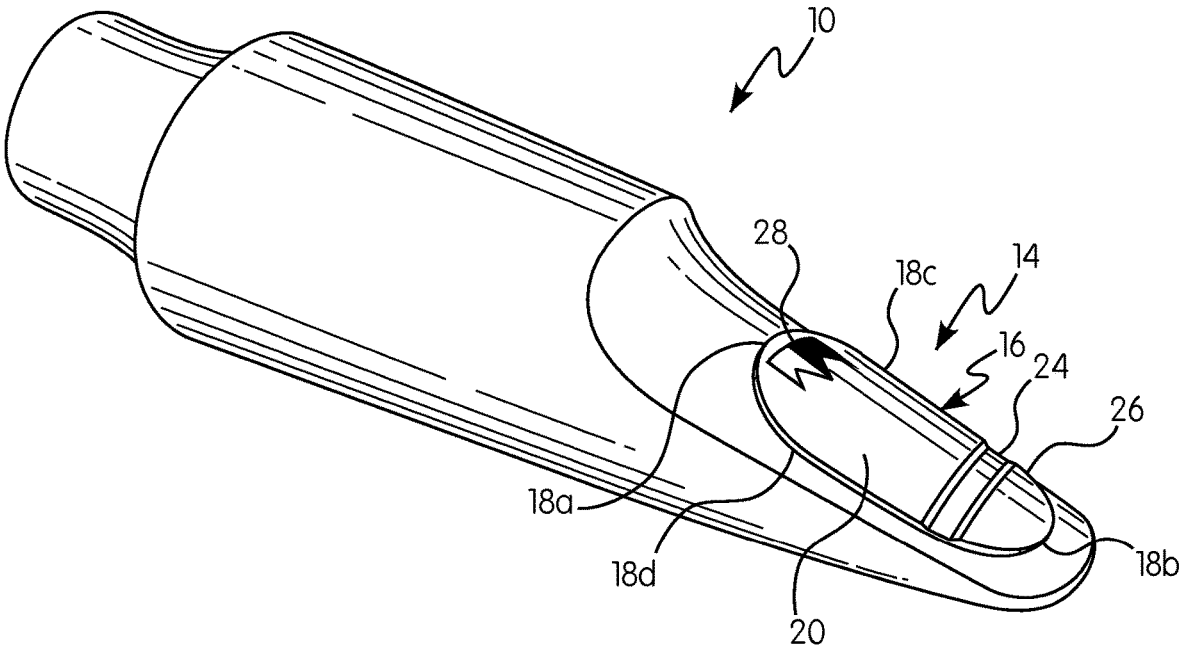
FIG. 2 is a perspective view of a mouthpiece for a wind instrument with the mouthpiece patch in accordance with the subject disclosure installed in the mouthpiece.
Figure 3:
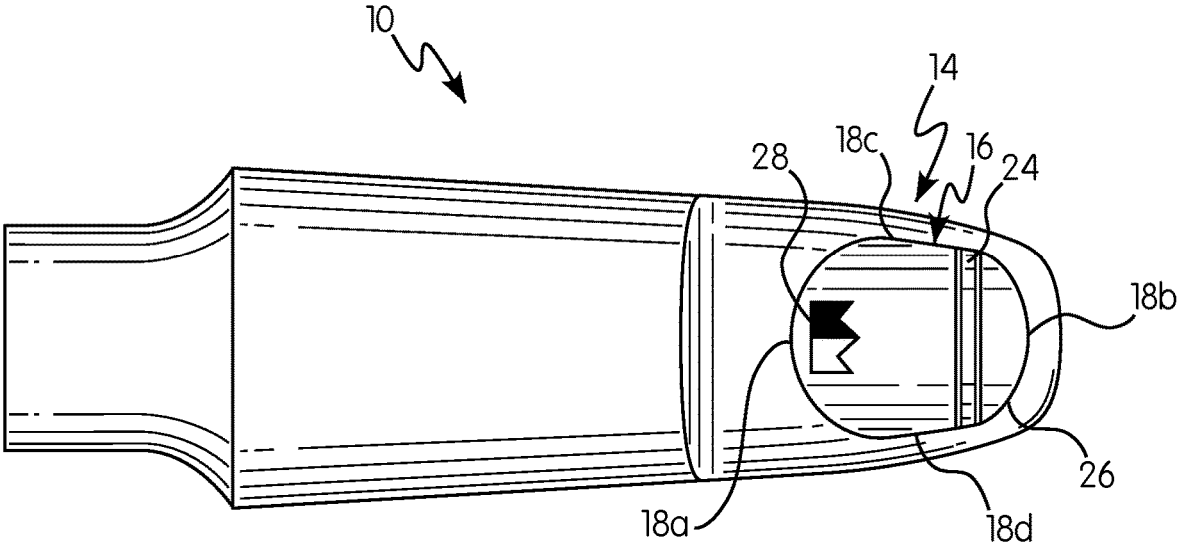
FIG. 3 is a top plan view of the mouthpiece for a wind instrument shown in FIG. 2.
Figure 4:
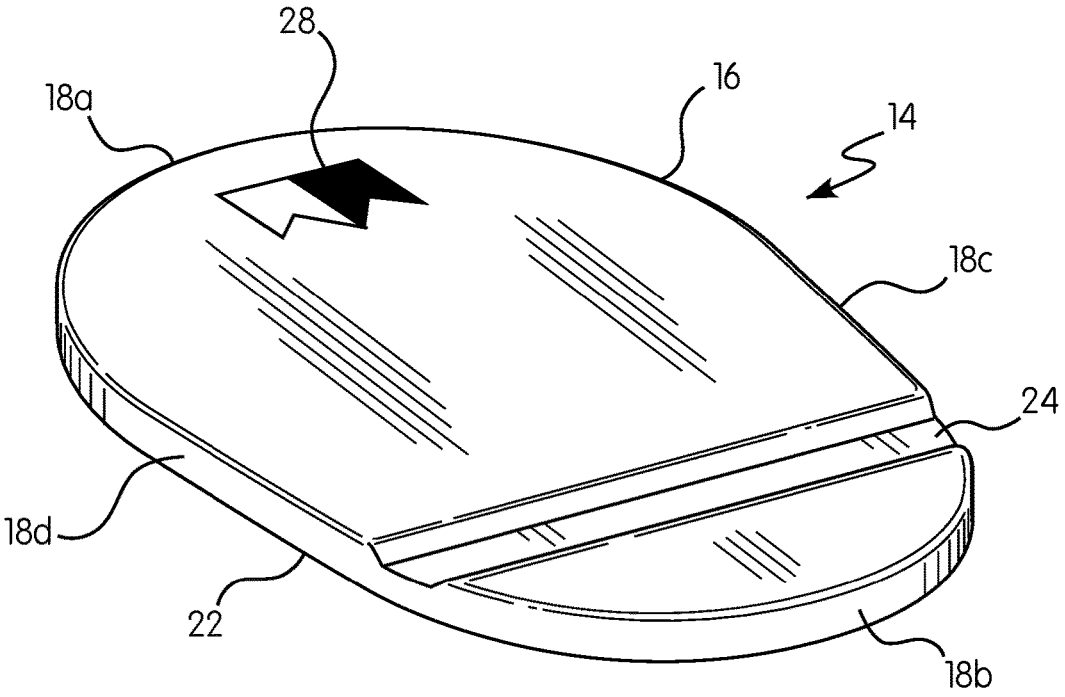
FIG. 4 is a perspective view of the mouthpiece patch in accordance with the subject disclosure.
Figure 5:
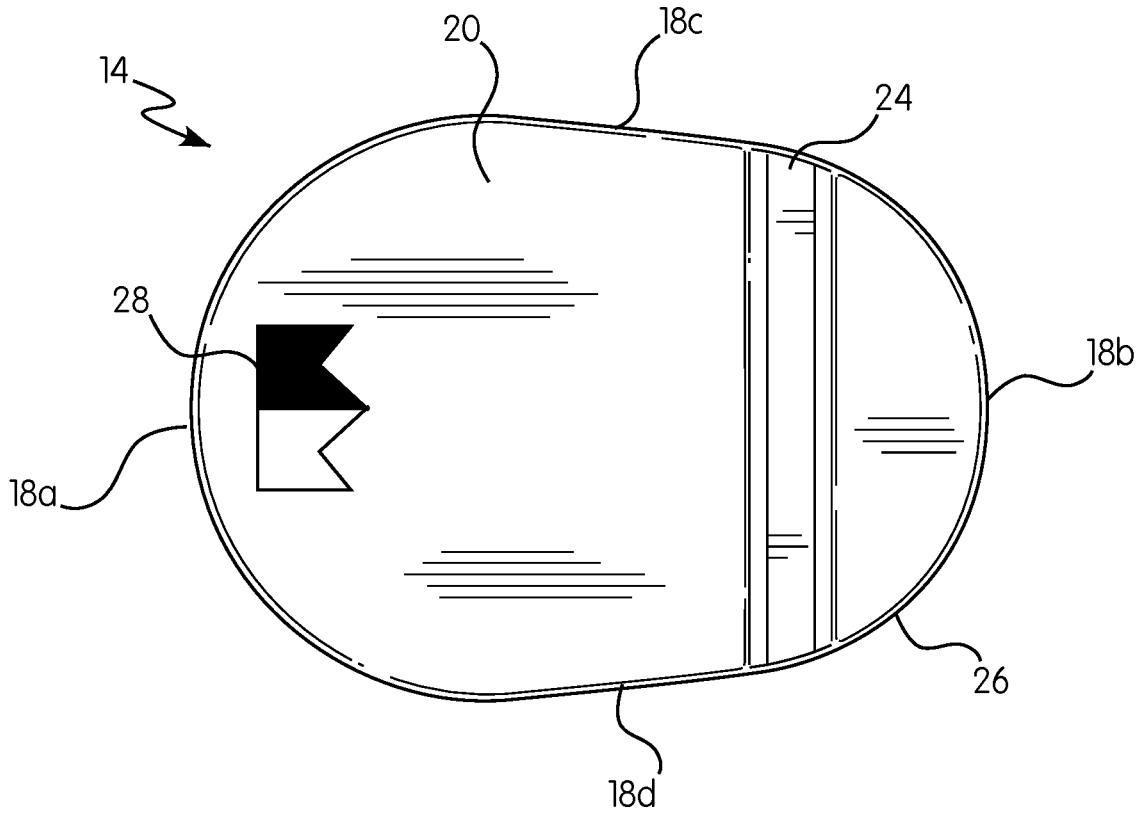
FIG. 5 is a top plan view of the mouthpiece patch shown in FIG. 4.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, +1%, or ±0.1% from the specified value, as such variations are appropriate.

"Substantially" as used herein shall mean considerable in extent, largely but not wholly that which is specified, or an appropriate variation therefrom as is acceptable within the field of art.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Referring now to the drawings, FIG. 1 illustrates a mouthpiece 10 for an unillustrated wind instrument. In accordance with a preferred embodiment, the present invention provides a mouthpiece patch for a mouthpiece of a wind instrument. The wind instrument may assume the form of any suitable wind instrument having a mouthpiece. Accordingly, a detailed description of such instrument is not necessary for a proper understanding of the subject disclosure. As shown in FIG. 1 the mouthpiece 10 includes a recessed portion 12 for receiving a mouthpiece patch 14 (as shown in FIGS. 2-6).

The mouthpiece patch 14 comprises a substantially planar body 16 comprising a polymer. The body 16 includes a posterior end 18*a*, an anterior end 18*b*, lateral side walls 18*c*, 18*d*, an upper surface 20 and a lower surface 22. The mouthpiece patch 14 also includes a recessed region 24 extending in a widthwise direction and configured to receive the teeth of a user. The recessed region 24 can be substantially linear. Alternatively, the recessed region 24 can be curved to match a profile of the user's teeth. In an exemplary aspect, the recessed region 24 extends from one lateral side wall 18*c* to the other lateral side wall 18*d*, although it may extend less than the width of the patch. The recessed region is disposed adjacent the anterior end 18*b* of the body 16.

The mouthpiece patch can have a substantially rectangular, substantially oval, substantially circular, or substantially square profile in plan view. The mouthpiece patch can have a curved posterior end 18*a* and a curved anterior end 18*b* along with substantially linear lateral side walls 18*c*, 18*d*. In an exemplary embodiment, all edges 26 of the body 16 are rounded to enhance sealing of air from the user's mouth to the mouthpiece.

In an exemplary embodiment, the polymer of the body 16 is formed from silicone e.g., food grade silicone or other biocompatible or inert material which does not adversely chemically react when inserted in a user's mouth. In addition, the body 16 can be flexible.

Figure 6:
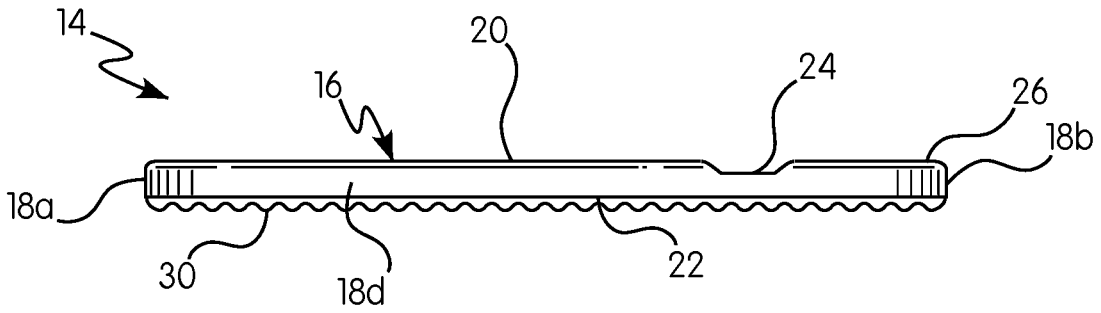
FIG. 6 is a side elevational view of the mouthpiece patch shown in FIG. 4.

As shown in FIGS. 2-5, the mouthpiece patch also includes indicia 28 for indicating use of the patch and placement of the user's teeth into the recessed region 24 of the body 16. The indicia can be positioned adjacent the posterior end 18*a* of the body. The indicia can be formed, for example, from non-toxic ink having arrow-like markings pointing towards the recessed region 24. As shown in FIG. 6, the lower surface of 22 of the mouthpiece patch 14 is provided with a fastener 30, such as an adhesive layer, for securing the mouthpiece patch to the mouthpiece 10. In an exemplary embodiment, the recessed portion 12 of the mouthpiece 10 is configured to matingly receive the mouthpiece patch 14.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

I claim:

1. A mouthpiece patch for a mouthpiece of a musical instrument comprising:

a substantially planar body comprising a polymer, the body including:
- a posterior end,
- an anterior end,
- lateral side walls,
- an upper surface,
- a lower surface, and
- a recessed region extending in a widthwise direction and configured to receive the teeth of a user, wherein the recessed region is curved to substantially match a profile of the user's teeth.

2. The mouthpiece patch of claim 1, wherein the recessed region has a substantially linear open face when viewed from a top plan view perspective.

3. The mouthpiece patch of claim 1, wherein the recessed region extends from one lateral side wall to the other lateral side wall.

4. The mouthpiece patch of claim 1, wherein the recessed region is disposed adjacent the anterior end of the body.

5. The mouthpiece patch of claim 1, wherein the mouthpiece patch has a substantially rectangular, substantially oval, substantially circular, or substantially square profile in plan view.

6. The mouthpiece patch of claim 1, wherein the anterior end is curved.

7. The mouthpiece patch of claim 1, wherein the posterior end is curved.

8. The mouthpiece patch of claim 1, wherein the lateral side walls are substantially linear.

9. The mouthpiece patch of claim 1, wherein all edges of the body are rounded to enhance sealing of air from the user's mouth to the mouthpiece.

10. The mouthpiece patch of claim 1, further comprising indicia for indicating use of the patch and placement of the user's teeth into the recessed region of the body.

11. A mouthpiece patch for a mouthpiece of a musical instrument comprising:

a substantially planar body comprising a polymer, the body including:
a posterior end,
an anterior end,
lateral side walls,
an upper surface,
a lower surface, and
a recessed region extending in a widthwise direction and configured to receive the teeth of a user; and
indicia for indicating use of the patch and placement of the user's teeth into the recessed region of the body.

12. The mouthpiece patch of claim 11, wherein the indicia is formed from non-toxic ink.

13. The mouthpiece patch of claim 11, wherein the polymer is silicone.

14. The mouthpiece patch of claim 11, wherein body is flexible.

15. The mouthpiece patch of claim 1, further comprising a fastener on the lower surface for securing the mouthpiece patch to a musical instrument mouthpiece.

16. A mouthpiece for a wind instrument comprising the mouthpiece patch of claim 1.

17. The mouthpiece for a wind instrument of claim 16, further comprising a recessed portion configured to matingly receive the mouthpiece patch of claim 1.

18. A mouthpiece patch for a mouthpiece of a musical instrument comprising:
a substantially planar body comprising a polymer, the body including:
a posterior end,
an anterior end,
substantially linear lateral side walls,
an upper surface,
a lower surface, and
a recessed region extending in a widthwise direction and configured to receive the teeth of a user.

19. A mouthpiece patch for a mouthpiece of a musical instrument comprising:
a substantially planar body comprising a polymer, the body including:
a posterior end,
an anterior end,
lateral side walls,
an upper surface,
a lower surface, and
a recessed region extending in a widthwise direction and configured to receive the teeth of a user,
wherein all edges of the body are rounded to enhance sealing of air from the user's mouth to the mouthpiece.

20. The mouthpiece patch of claim 11, wherein the indicia is positioned adjacent the posterior end of the body.

* * * * *